US010383453B2

(12) United States Patent
Huang

(10) Patent No.: US 10,383,453 B2
(45) Date of Patent: Aug. 20, 2019

(54) AIR SUPPLY APPARATUS FOR AIR MATTRESS

(71) Applicant: Chi-Chung Huang, Chiayi (TW)

(72) Inventor: Chi-Chung Huang, Chiayi (TW)

(73) Assignee: Apex Health Care MFG. INC., Chiayi (TW)

( * ) Notice: Subject to any disclaimer, the term of this patent is extended or adjusted under 35 U.S.C. 154(b) by 251 days.

(21) Appl. No.: 15/630,554

(22) Filed: Jun. 22, 2017

(65) Prior Publication Data

US 2017/0280885 A1 Oct. 5, 2017

(51) Int. Cl.

| | |
|---|---|
| ***A47C 21/06*** | (2006.01) |
| ***A47C 27/08*** | (2006.01) |
| ***A47C 20/02*** | (2006.01) |

(52) U.S. Cl.

CPC ..... *A47C 27/082* (2013.01); *A47C 20/02* (2013.01); *A47C 27/081* (2013.01)

(58) Field of Classification Search

CPC ..... A47C 21/06
USPC ..... 5/659, 660, 655.3, 713
See application file for complete search history.

(56) References Cited

U.S. PATENT DOCUMENTS

2003/0188387 A1* 10/2003 Leventhal ..... A47C 20/048 5/660
2006/0117486 A1* 6/2006 Clark ..... A47C 21/06 5/659

* cited by examiner

*Primary Examiner* — Fredrick C Conley

(57) ABSTRACT

An air supply apparatus is between an air mattress and a foundation including transverse openings. The air supply apparatus elevates the air mattress and includes a transverse air bladder; a connection assembly including a first line having one end connected to an outlet of an air compressor and communicating therewith, a female connector at the other end of the first line, a check valve in the female connector and communicating with the first line, a second line having the other end coupled to the air bladder by passing through the transverse openings so as to communicate with the air bladder, and a male connector at one end of the second line and including a port wherein the female connector is inserted into the male connector to connect the check valve and the port together; and straps on a top of the foundation for fastening the air bladder thereon.

5 Claims, 8 Drawing Sheets

AIR SUPPLY APPARATUS FOR AIR MATTRESS

BACKGROUND OF THE INVENTION

1. Field of the Invention

The invention relates to air mattresses and more particularly to an improved air supply apparatus for an air mattress.

2. Description of Related Art

A conventional air supply apparatus for an air mattress comprises a housing, an air supply disposed within the housing, a first hanger coupled to the housing, and a second hanger coupled to the housing. The first hanger couples the housing to a footboard in a first orientation. The second hanger couples the housing to the footboard in a second orientation.

While the apparatus enjoys its success in the market, continuing improvements in the exploitation of air supply apparatus for an air mattress of this type are constantly being sought.

SUMMARY OF THE INVENTION

It is therefore one object of the invention to provide an air supply apparatus disposed between an air mattress and a foundation including a plurality of transverse openings, the air supply apparatus being configured to elevate the air mattress, comprising at least one transverse air bladder; an air compressor; a connection assembly including a first line having one end connected to an outlet of the air compressor and communicating therewith, a female connector disposed at the other end of the first line, a check valve disposed in the female connector and configured to communicate with the first line, a second line having the other end coupled to the at least one air bladder by passing through the transverse openings so as to communicate with the at least one air bladder, and a male connector disposed at one end of the second line and including a port wherein the female connector is configured to insert into the male connector to connect the check valve and the port together; and at least one strap disposed on a top surface of the foundation for securing the at least one air bladder onto the top surface of the foundation.

The above and other objects, features and advantages of the invention will become apparent from the following detailed description taken with the accompanying drawings.

DETAILED DESCRIPTION OF THE INVENTION

Figure 1:
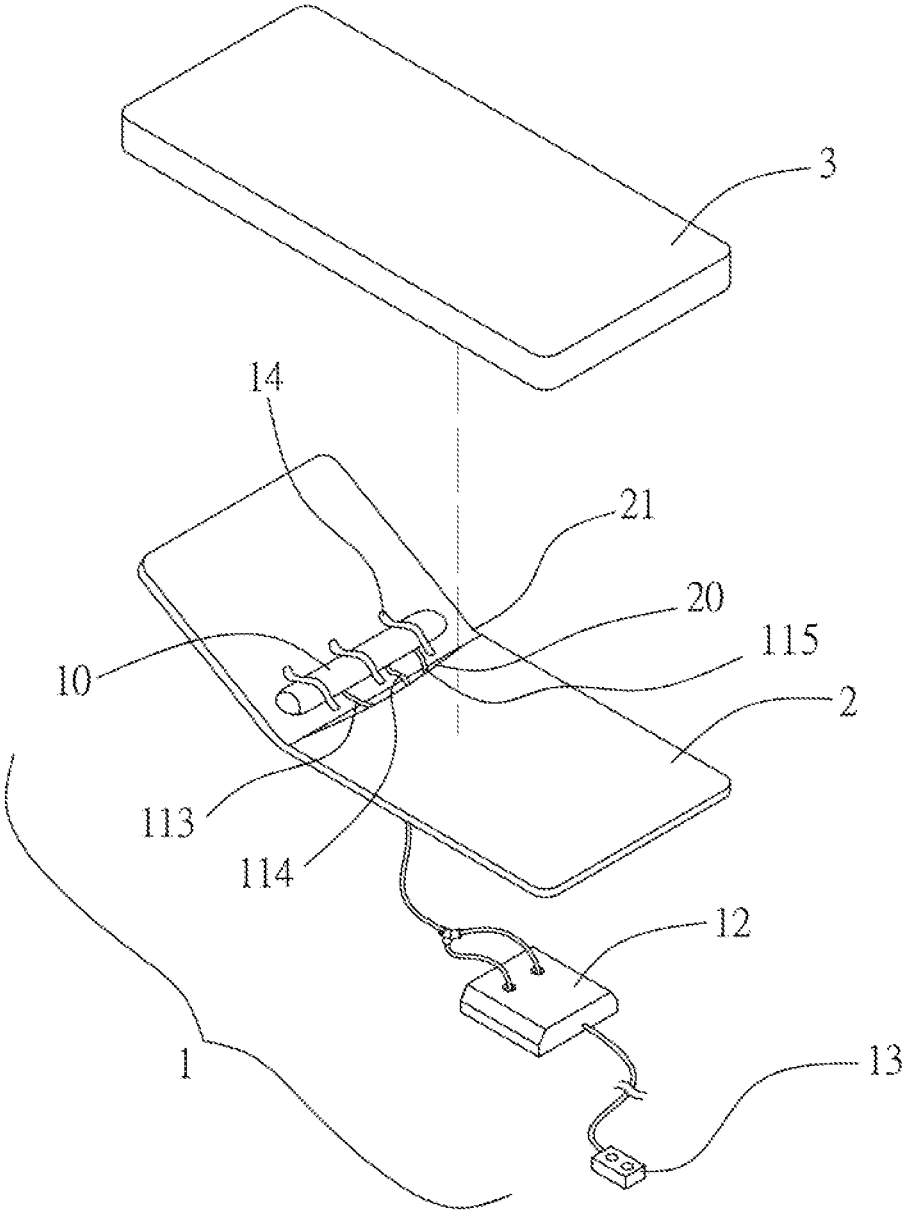
FIG. 1 is an environmental view an according to a first preferred embodiment of the invention mounted to a foundation and to be mounted with an air mattress.
Figure 2:
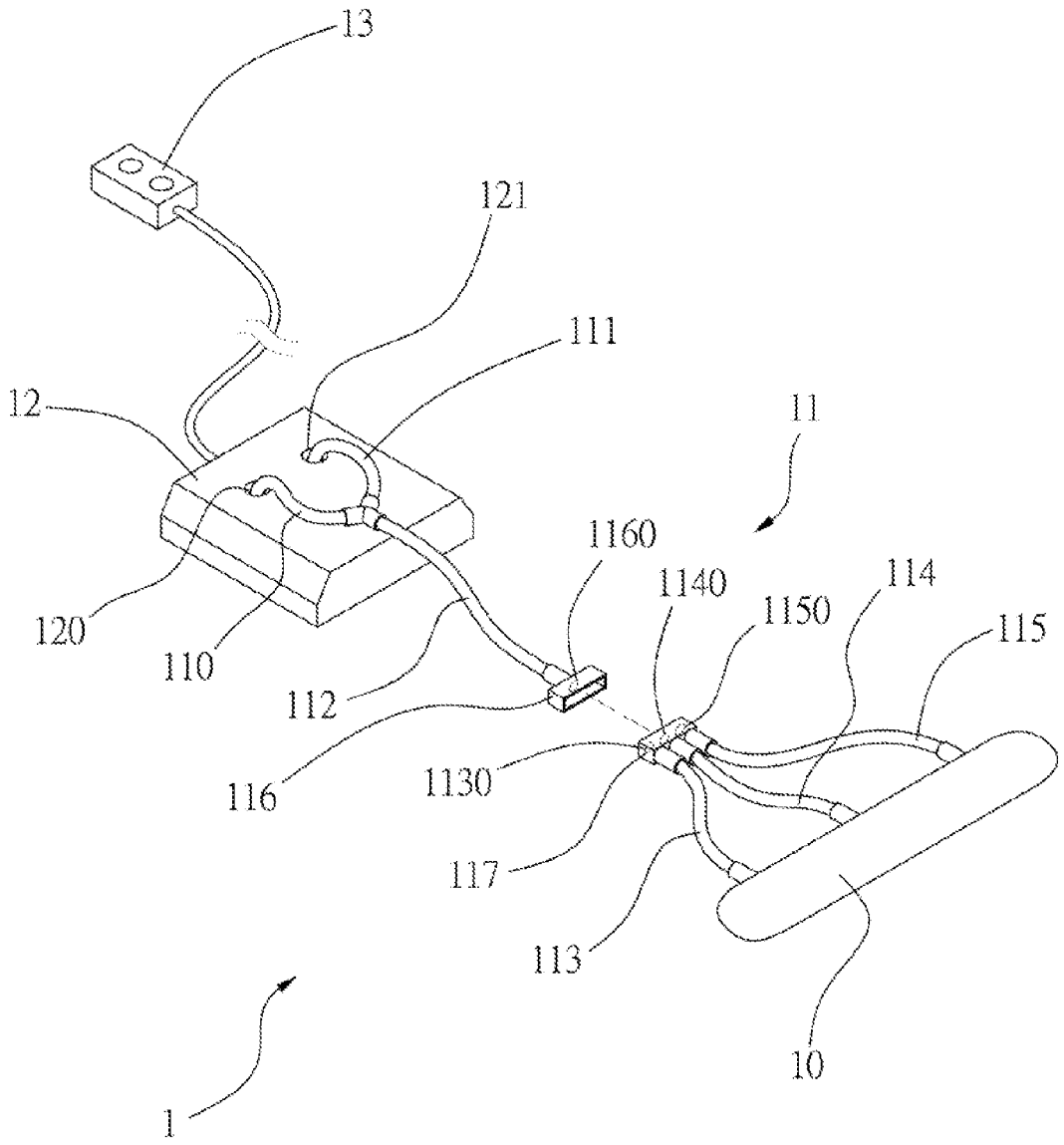
FIG. 2 is a perspective view of the air supply apparatus.
Figure 3:
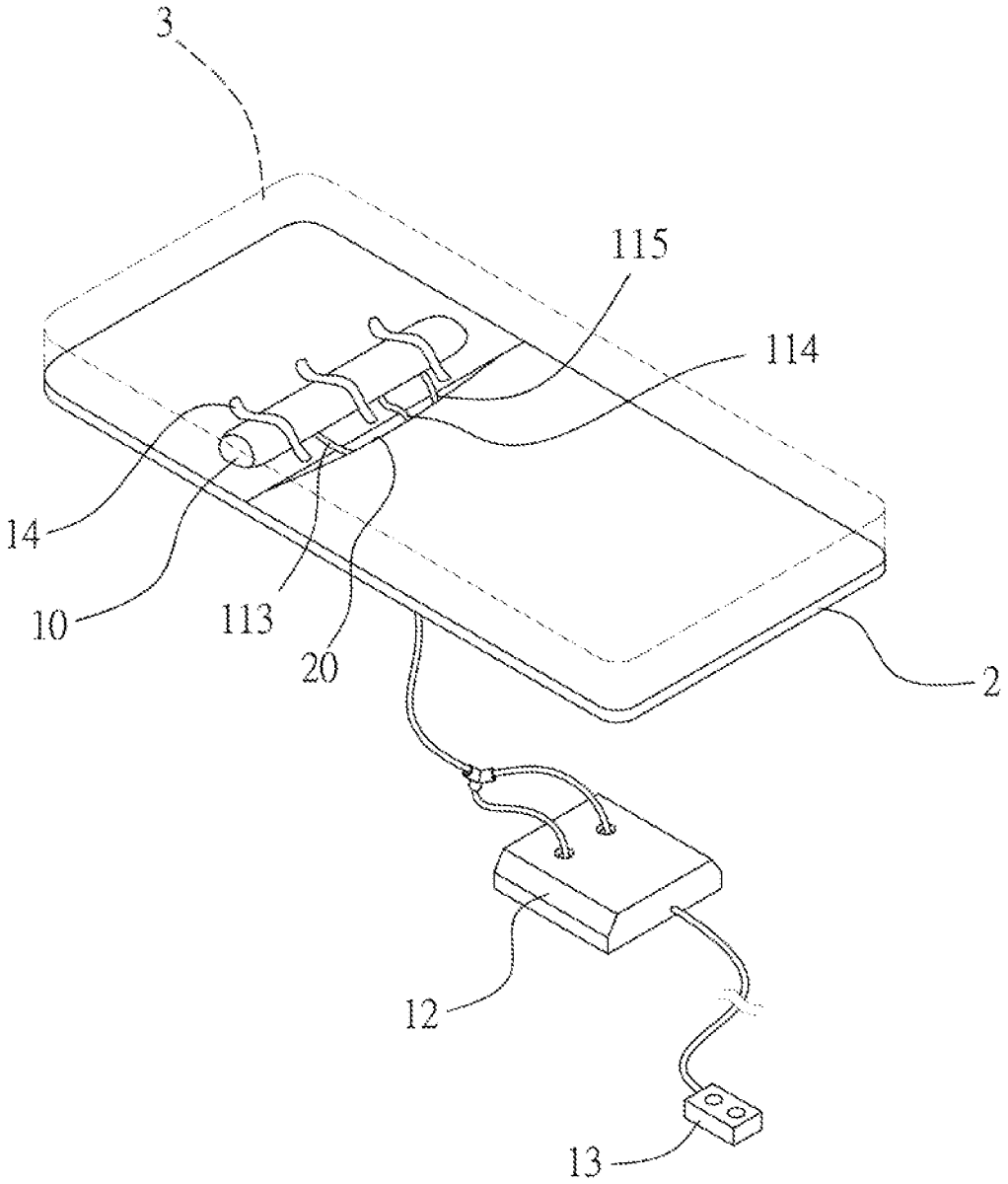
FIG. 3 is a perspective view of the assembled air supply apparatus, the foundation and the air mattress.

Referring to FIGS. 1 to 6, an air supply apparatus 1 in accordance with the invention comprises the following components as discussed in detail below.

A transverse air bladder 10 is provided. A connection assembly 11 includes a first line 110, a second line 111, a third line 112 having one end coupled to the other ends of the first and second lines 110 and 111, a fourth line 113 having the other end coupled to the air bladder 10, a fifth line 114 having the other end coupled to the air bladder 10, and a sixth line 115 having the other end coupled to the air bladder 10. An air compressor 12 includes a first inlet 120 coupled to one end of the first line 110, and a second outlet 121 coupled to one end of the second line 111. A switch 13 is electrically connected to the air compressor 12 for controlling the activation of the air compressor 12. A plurality of parallel straps 14 are provided on a top surface of a rectangular foundation 2. The air bladder 10 is inserted through gaps between the straps 14 and the top surface of the foundation 2 and fastened on the foundation 2 by the elastic compression of the straps 14. The foundation 2 includes a plurality of transverse openings 20 for allowing the other ends of the fourth, the fifth and the sixth lines 113, 114 and 115 to pass through to couple to the air bladder 10. The foundation 2 further comprises a lumbar zone 21, a head zone 22, and a leg zone 23. A rectangular, inflated air mattress 3 is placed on the foundation 2.

A female connector 116 is provided at the other end of the third line 112. The female connector 116 includes a check valve 1160 communicating with the third line 112. A male connector 117 is provided at one ends of the fourth, the fifth and the sixth lines 113, 114 and 115. The male connector 117 includes a first port 1130 communicating with the fourth line 113, a second port 1140 communicating with the fifth line 114, and a third port 1150 communicating with the sixth line 115 respectively. The female connector 116 is inserted into the male connector 117 to be connected together. The air bladder 10 can be inflated by performing the steps of turning on the switch 13 to activate the air compressor 12, and transporting pressurized air from the air compressor 12 to the air bladder 10 via the first and second outlets 120 and 121, the first line 110, the third line 112, the check valve 1160, the first, the second, and the third ports 1130, 1140, and 1150, and the fourth, the fifth and the sixth lines 113, 114 and 115.

After turning off the switch 13, the air bladder 10 can maintain its inflated state for a predetermined period of time duo to the provision of the check valve 1160. The air bladder 10 can be deflated by disconnecting the female connector 116 from the male connector 117 and expelling air in the air bladder 10 to the atmosphere via the fourth, the fifth and the sixth lines 113, 114 and 115, and the first, the second, and the third ports 1130, 1140, and 1150.

Figure 4:
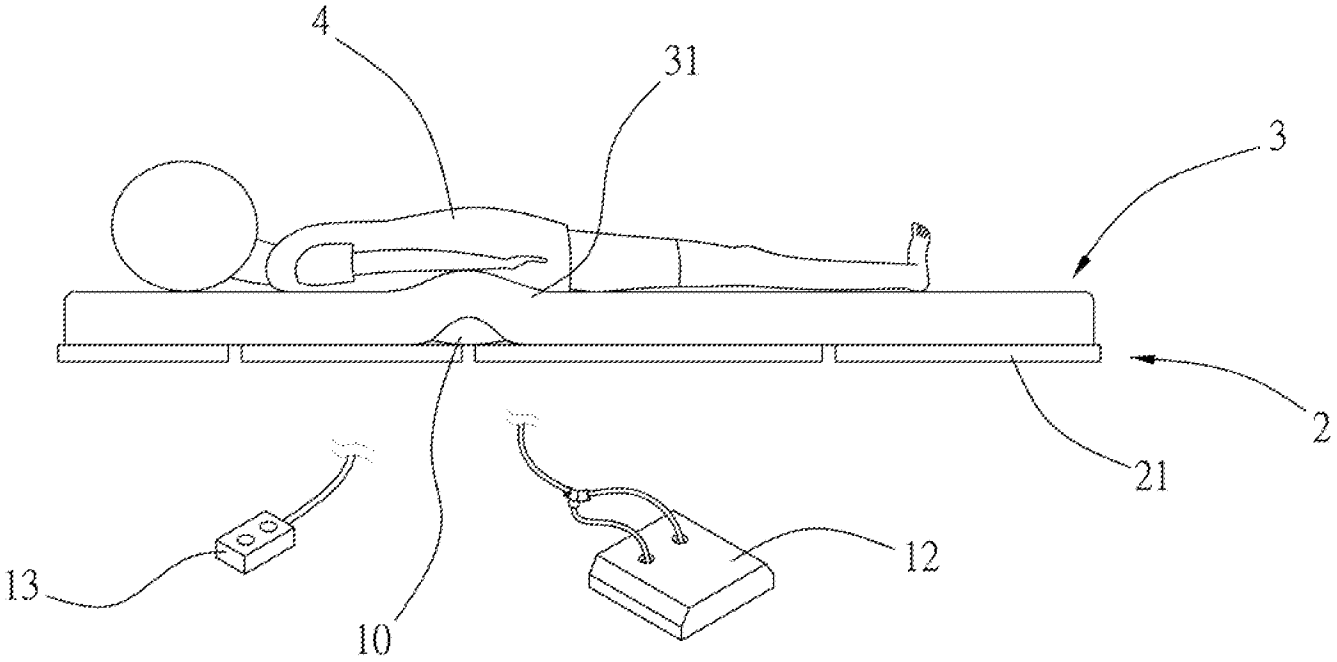
FIG. 4 is a side elevation of FIG. 3 showing a patient lying on the air mattress and the air bladder disposed in a first position.

As shown in FIG. 4, the air bladder 10 is disposed under a lumbar zone 31 of the air mattress 3 when a user 4 lies on the air mattress 3. This accommodates a user 4 having such preferred position.

Figure 5:
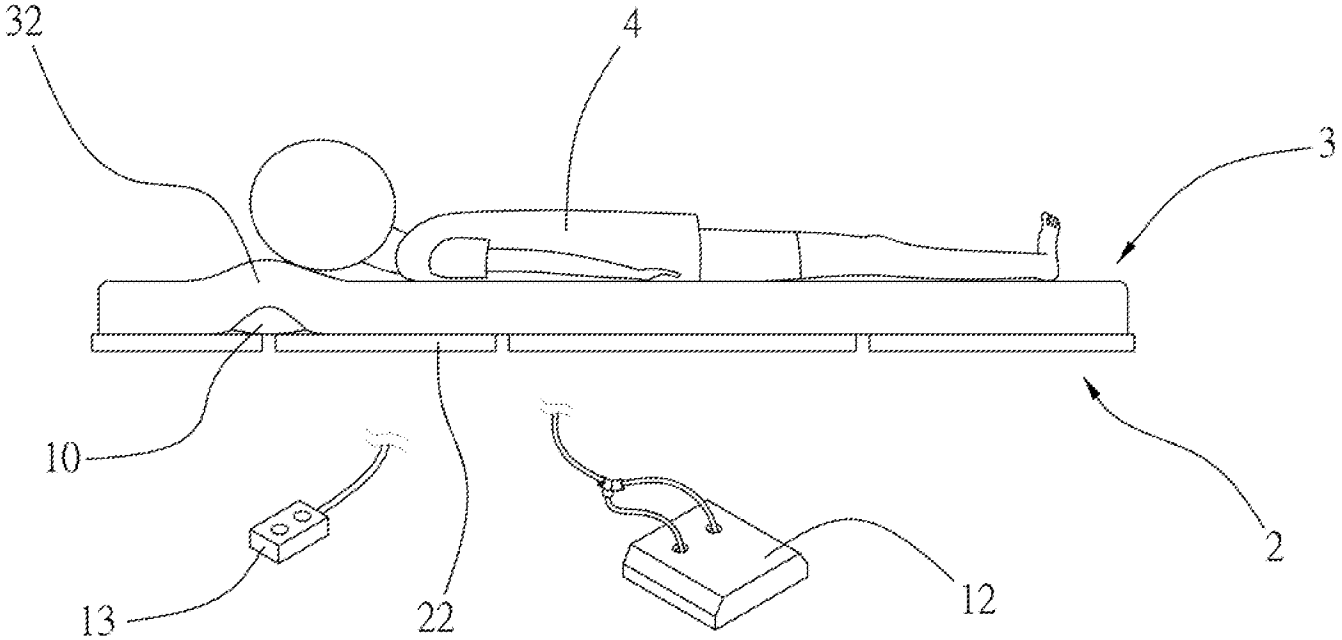
FIG. 5 is a view similar to FIG. 4 showing the air bladder disposed in a second position.

As shown in FIG. 5, the air bladder 10 is disposed under a head zone 32 of the air mattress 3 when a user 4 lies on the air mattress 3. This accommodates a user 4 having such preferred position.

Figure 6:
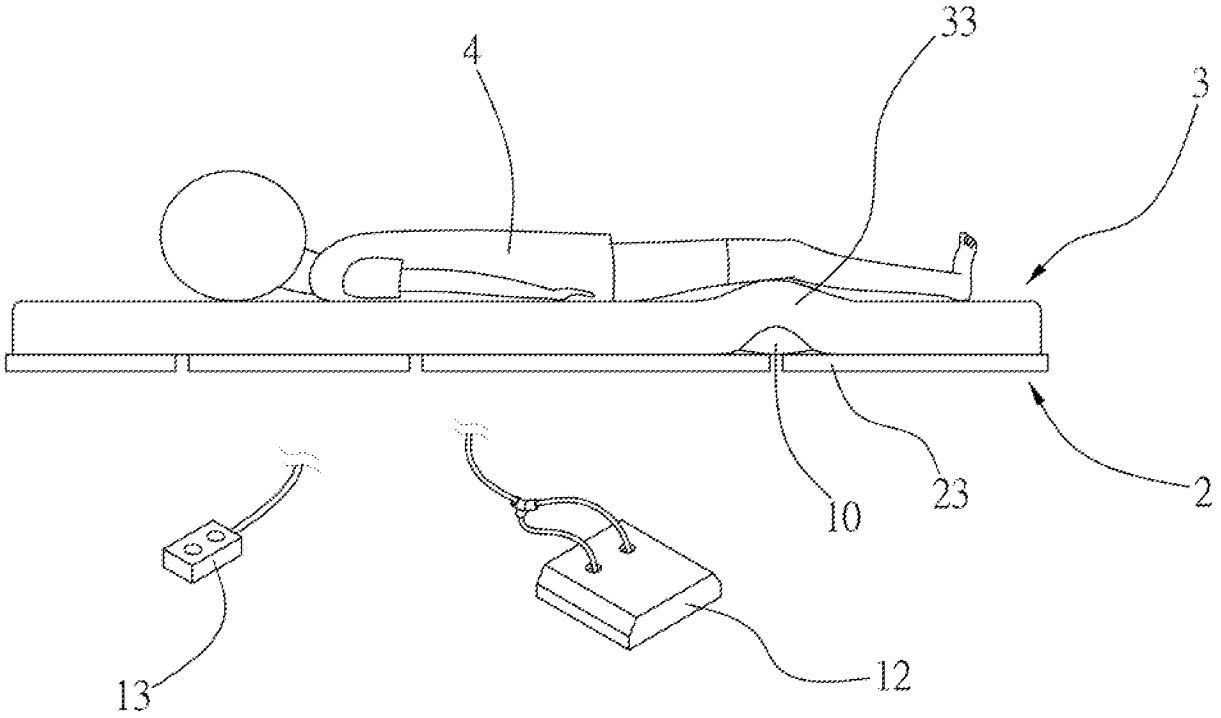
FIG. 6 is a view similar to FIG. 4 showing the air bladder disposed in a third position.

As shown in FIG. 6, the air bladder 10 is disposed under a leg zone 33 of the air mattress 3 when a user 4 lies on the air mattress 3. This accommodates a user 4 having such preferred position.

Figure 7:
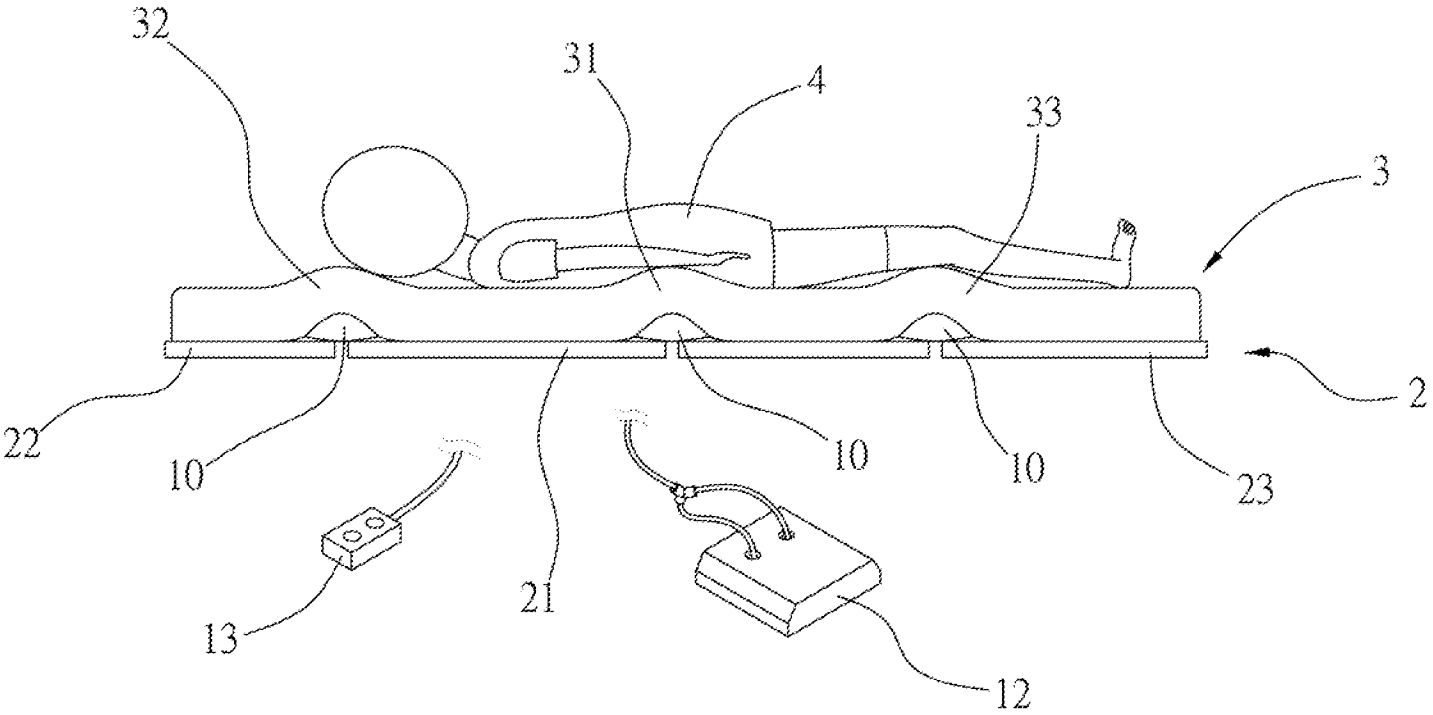
FIG. 7 is a view similar to FIG. 4 showing the air bladders disposed in a fourth position.

Referring to FIG. 7 in conjunction with FIGS. 1 to 5, there are three air bladders 10 provided. The air bladders 10 are disposed under the head zone 32, the lumbar zone 31, and the leg zone 33 of the air mattress 3 respectively. This accommodates a user 4 having such preferred position.

Figure 8:
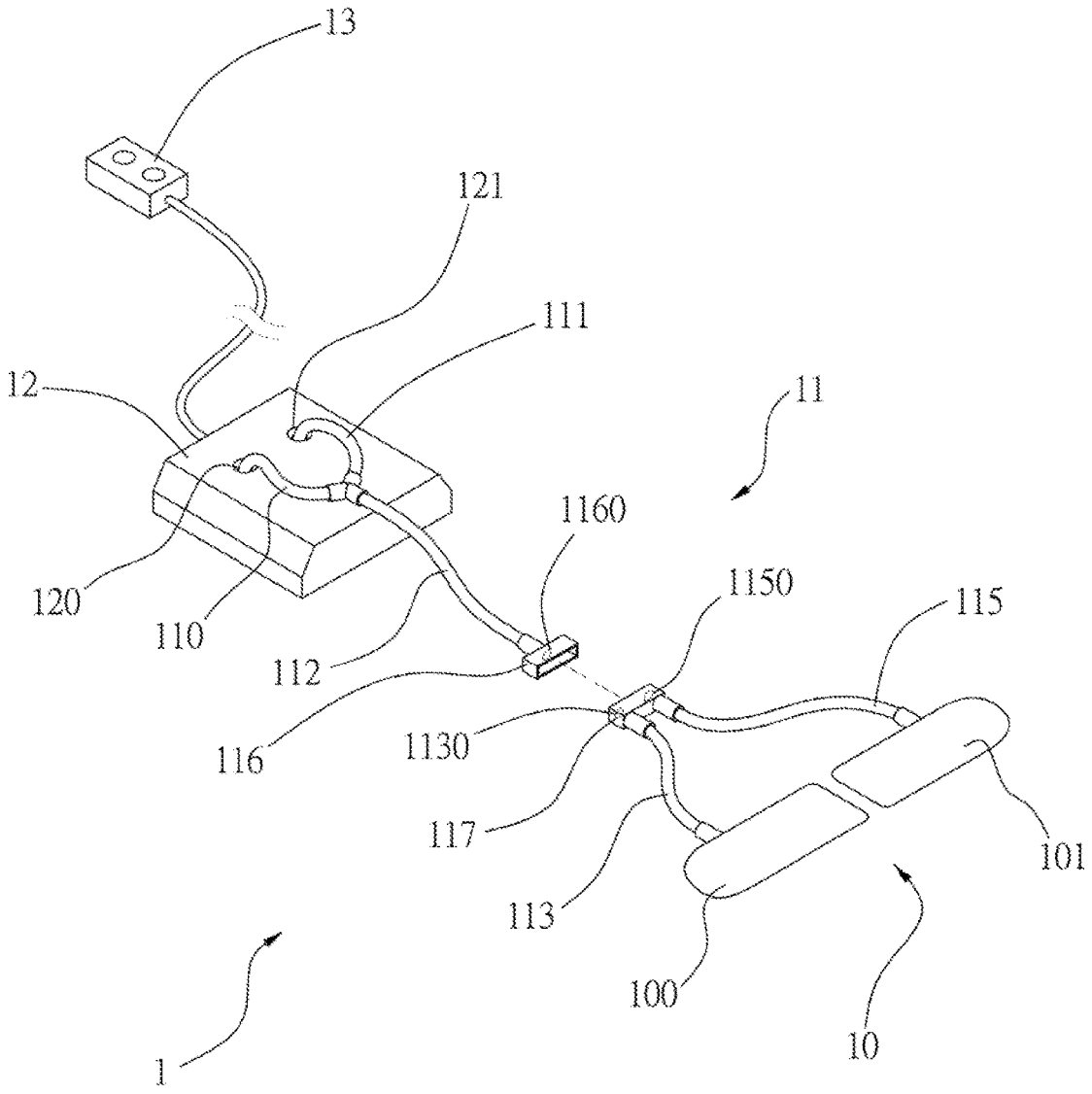
FIG. 8 is an environmental view an according to a second preferred embodiment of the invention.

Referring to FIG. 8, an air supply apparatus 1 for an air mattress in accordance with a second preferred embodiment of the invention is shown. The characteristics of the second preferred embodiment are substantially the same as that of the first preferred embodiment except the following: The air bladder 10 is divided into two independent first and second air bladder members 100 and 101. The first air bladder member 100 communicates with the fourth line 113 and the second air bladder member 101 communicates with the sixth line 115 respectively. In use, the first air bladder member 100 can be inflated by opening the first port 1130 and connecting the female connector 116 and the male connector 117 together. Similarly, the second air bladder member 101 can be inflated by opening the third port 1150 and connecting the female connector 116 and the male connector 117 together. This accommodates two users lying on a mattress having different preferred positions.

While the invention has been described in terms of preferred embodiments, those skilled in the art will recognize that the invention can be practiced with modifications within the spirit and scope of the appended claims.

What is claimed is:

1. An air supply apparatus disposed between an air mattress and a foundation including a plurality of transverse openings, the air supply apparatus being configured to elevate the air mattress, comprising:

at least one transverse air bladder;

an air compressor;

a connection assembly including a first line having one end connected to an outlet of the air compressor and communicating therewith, a female connector disposed at the other end of the first line, a check valve disposed in the female connector and configured to communicate with the first line, a second line having the other end coupled to the at least one air bladder by passing through the transverse openings so as to communicate with the at least one air bladder, and a male connector disposed at one end of the second line and including a port wherein the female connector is configured to insert into the male connector to connect the check valve and the port together; and at least one strap disposed on a top surface of the foundation for securing the at least one air bladder onto the top surface of the foundation.

2. The air supply apparatus of claim 1, wherein the female connector includes a check valve, and wherein the male connector includes a port.

3. The air supply apparatus of claim 1, wherein the at least one strap is configured to secure the at least one air bladder to at least one of a lumbar zone, a head zone, and a leg zone of the foundation.

4. The air supply apparatus of claim 1, wherein the number of the at least one air bladder is two, and the plurality of air bladders are disposed on the foundation in parallel and configured to inflate independently or as a whole.

5. The air supply apparatus of claim 1, wherein each of the at least one air bladder is configured to divide into two independent first and second air bladder members which are configured to inflate independently or as a whole.

* * * * *